United States Patent [19]

Iotti

[11] 4,306,396

[45] Dec. 22, 1981

[54] LAMINATED PARTITION FOR BUILDING APPLICATIONS

[75] Inventor: Tullio Iotti, Saint Nom la Bretagne, France

[73] Assignees: Arnaldo Iotti, Saint Nom la Breteche; Leo Iotti, Igny; Bruno Iotti, Saint Sulpice les Feuilles; Regine Iotti, Saint Nom la Breteche, all of France

[21] Appl. No.: 114,507

[22] Filed: Jan. 23, 1980

[30] Foreign Application Priority Data

Feb. 5, 1979 [FR] France ..... 79 02841

[51] Int. Cl.[3] ..... E04H 1/00

[52] U.S. Cl. ..... 52/238; 52/268; 52/281; 52/266

[58] Field of Search ..... 52/267, 268, 269, 281, 52/481, 410, 266, 238, 408

[56] References Cited

U.S. PATENT DOCUMENTS

| | | | |
|---|---|---|---|
| 1,985,196 | 12/1934 | Tashjian | 52/238 X |
| 1,990,656 | 2/1935 | Kotrbaty | 52/238 X |
| 3,074,123 | 1/1963 | Gartrell | 52/408 X |
| 3,509,673 | 5/1970 | Witkosky et al. | 52/281 X |
| 3,593,475 | 7/1971 | LaGue | 52/481 X |
| 3,640,039 | 2/1972 | Mckee et al. | 52/281 |
| 3,911,636 | 10/1975 | Larsson | 52/481 X |
| 4,020,611 | 5/1977 | Amos | 52/584 |
| 4,114,333 | 9/1978 | Jones et al. | 52/281 X |

FOREIGN PATENT DOCUMENTS

| | | |
|---|---|---|
| 1658790 | 11/1970 | Fed. Rep. of Germany . |
| 2611033 | 9/1977 | Fed. Rep. of Germany . |
| 2648935 | 5/1978 | Fed. Rep. of Germany . |
| 2125211 | 2/1971 | France . |
| 2363672 | 3/1978 | France . |

*Primary Examiner*—Price C. Faw, Jr.
*Assistant Examiner*—Carl D. Friedman

[57] ABSTRACT

This laminated partition for building applications comprises spaced uprights and, in each space formed between two uprights, a sandwich structure comprising a plurality of layers of materials, namely a central layer or core consisting of at least one rectangular plate of a first material having a low density and a high degree of sound and thermal insulation, and on either side of the core an intermediate layer consisting of at least one rigid rectangular plate having its vertical edges fastened to the uprights, and made of a second material having a density which is low but higher than that of the first material, said second material having good sound and thermal insulation properties, and an outer lining layer bonded to the outer surface of the adjacent intermediate layer and made of a non-inflammable material having good sound and thermal insulation properties, and a density higher than that of the second material.

13 Claims, 9 Drawing Figures

LAMINATED PARTITION FOR BUILDING APPLICATIONS

BACKGROUND OF THE INVENTION

This invention relates in general to building panels and has specific reference to a laminated partition notably for dwelling-houses and business premises, which comprises uprights disposed at predeterminated intervals and, in each space between two adjacent uprights, a sandwich structure consisting of a several layers of materials.

The present trend in the housing industry is towards fire-proof partitions having high acoustic and thermal insulation properties and capable of sparing skilled manpower of which the shortage increases every day.

SUMMARY OF THE INVENTION

It is the essential object of this invention to provide a laminated partition made of currently available products and materials which, after having been assembled in a manner to be described in detail presently, can be converted into a partition capable of meeting all building requirements and regulations and having more particularly very satisfactory sound insulation properties.

To this end, the partition according to the present invention is characterised in that its sandwich structure comprises a central layer or core consisting of at least one rectangular plate made of a first material having a low density and high sound and thermal insulation properties, and, on either side of said core, an intermediate layer consisting of at least one rectangular, rigid plate having vertical edges secured to said uprights and made of a second material the density of which, though relatively low, is higher than that of said first material, said second material having good thermal and sound insulation properties, and an external lining layer bonded to the adjacent intermediate layer and made of a fire-proof material having good thermal insulation properties and a higher density than that of said intermediate layer.

Preferably, the density of the core-forming material ranges from about 60 kg/m$^3$ to about 120 kg/m$^3$, the density of each intermediate layer ranging from about 300 kg/m$^3$ to about 700 kg/m$^3$, and the density of each external lining layer ranges from about 800 kg/m$^3$ to about 1,200 kg/m$^3$. The core may consist for example of at least one plate made of a mineral wool such as glass-wool or rock-wool. Each intermediate layer may consist for example of at least one plate of wood chips or fibers agglomerated by means of cement or plaster, or at least one plate of expanded clay or expanded plaster. Each external lining layer may consist for example of a plaster layer coating the adjacent intermediate layer, or of at least one plate of plasterboard, stuffed plaster or asbestos cement, or still of previously fire-proofed wooden panels, blades or battens bonded to the adjacent intermediate layer.

Due to the provision, between the external lining layers forming the exposed faces of the partition, of three layers of insulating materials having different densities, a high degree of sound and thermal insulation is achieved. According to a preferred embodiment of the invention, the central layer or core comprises 20-mm thick rock-wool plates, each intermediate layer consists of 20-mm thick plates of wood fibers agglomerated with "Portland" cement, and each external lining layer consists of a 10-mm thick plaster board plate, so that the total thickness of the partition is about 80 mm. A partition prepared with the above-described component elements is characterized by a very satisfactory degree of sound insulation.

Now various embodiments of the partition of the invention will be described by way of example with reference to the attached drawings, in which:

DESCRIPTION OF THE PREFERRED EMBODIMENTS

Figure 1:
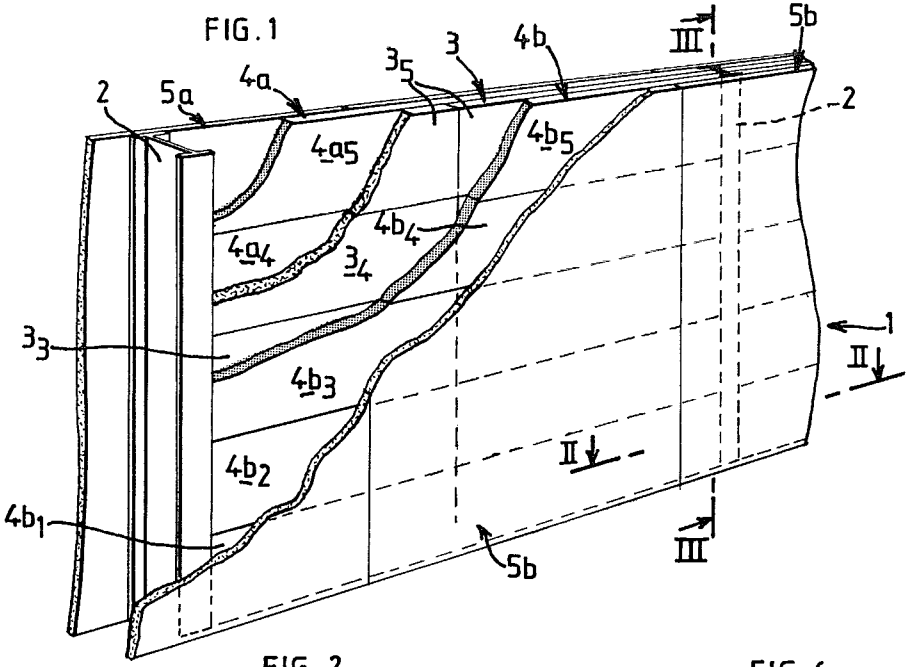
FIG. 1 is a perspective view with parts broken away illustrating a laminated partition according to a first embodiment of the invention, the component elements of the partition being assembled on the building site.
Figure 3:
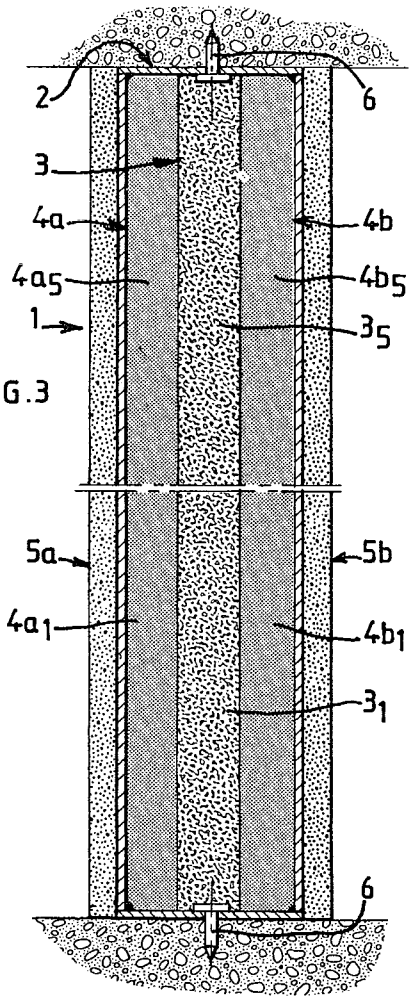
FIG. 3 is a vertical cross section taken along the line III—III of FIG. 1.
Figure 2:
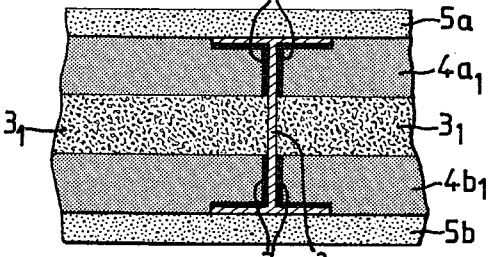
FIG. 2 is a fragmentary horizontal section taken along the line II—II of FIG. 1.

The laminated partition illustrated in FIGS. 1 to 3 of the drawings comprises essentially uprights or posts 2 and, in the spaces between two adjacent uprights 2, a sandwich structure comprising a central, core-forming layer 3, a pair of intermediate layers 4*a* and 4*b* disposed on either side of said central layer 3, and a pair of external lining layers 5*a* and 5*b* bonded to the outer surfaces of said intermediate layers 4*a* and 4*b*, respectively.

The laminated partition 1 is assembled in situ. To this end, the uprights 2 are firstly erected in a vertical position with a relative spacing of two meters or less according to the development of the partition contemplated. Each upright 2 may consist for example of an I-shaped section of adequate iron or steel grade, galvanized or rust-proofed according to any known and suitable method. The width of the central web of each I-shaped section 2 corresponds substantially to the added thicknesses of the central layer 3 and of the pair of intermediate layers 4*a* and 4*b*.

The I-shaped sections 2 are enchored or fastened to the floor and to the ceiling through any suitable means. For example, as illustrated in FIG. 3, they can be secured to the floor and ceiling by means of steel pins 6 driven home by using an air gun or any other suitable means.

When the I-shaped sections 2 are erected and duly fastened in position, the central layer 3 and the pair of intermediate layers 4*a* and 4*b* are built up to form a sandwich assembly. To this end, ready-for-use rectangular plates consisting of wooden fibers agglomerated by "Portland"cement and ready-for-use rectangular plates of glass-or rock-wool are used for forming the intermediate layers 4*a* and 4*b* and the core 3, respectively. Assuming a 2-meter space between a pair of successive uprights 2, and a 2.5 m. height measured between the floor and the ceiling, for example five rectangular plates $4a_1$ to $4a_5$ each having a length of about 2 m and a width of about 0.5 m may be used for forming the layer 4*a*, five plates $4b_1$ to $4b_5$ identical with plates $4a_1$ to $4a_5$ for forming the opposite layer 4*b*, and ten plates each having a length of 1 m and a width of 0.5 m for forming the central layer or core 3. As shown in FIG. 1, the plates are laid horizontally and superposed in coplanar and edge-to-edge relationship to form five superposed rows. The plates are laid row after row by beginning with the first or bottom row which is formed by disposing two plates $3_1$ end to end between the two plates $4a_1$ and $4b_1$, and by bonding the two plates $4a_1$ and $4b_1$ to the floor and also to the uprights 2 by using quick-setting cement or a suitable adhesive substance or bonding product 7 (see FIG. 2). The core plates $3_1$ are not bonded to plates $4a_1$ and $4b_1$. The next rows are then formed in the same fashion and laid in position in succession above the preceding row. Each time, the two plates $4a_i$ and $4b_i$ are bonded at their vertical edges to the adjacent uprights 2 and at their bottom horizontal edges to the top horizontal edges of plates $4a_{i-1}$ and $4b_{i-1}$ of the preceding row by using said quick-setting cement or adhesive substance. The upper horizontal edges of plates $4a_5$ and $4b_5$ of the fifth row are also bonded to the ceiling.

Figure 4:
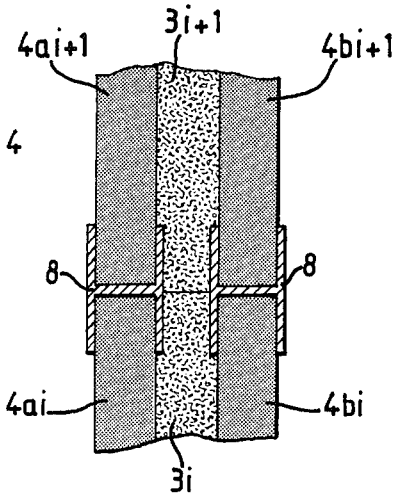
FIG. 4 is a fragmentary vertical cross section illustrating a detail.

Due to the relatively moderate thickness of the plates forming the intermediate layers 4*a* and 4*b*, it may happen under certain circumstances that said plates won't be strictly flat so that difficulties may be experienced in attempting to juxtapose them in proper mutual vertical and coplanar alignment. To avoid this shortcoming, H-shaped braces 8 (FIG. 4) may be used. The braces 8 are fitted in position, as the assembling operation proceeds, between the plates of adjacent rows. As illustrated in FIG. 4, each brace 8 has a thickness substantially equal to the thickness of the plates constituting the layers 4*a* or 4*b* and receives on its lower side the upper horizontal edge of plate $4a_i$ or $4b_i$, and on its upper or opposite side the lower horizontal edge of plate $4a_{i+1}$ or $4b_{i+1}$. At least one brace 8 is provided between two adjacent superposed plates and said brace is located mid-length of the horizontal edges of said plates concomitantly with the setting of cement, glue or other adhesive substance for bonding the horizontal rows to each other.

Figure 5:
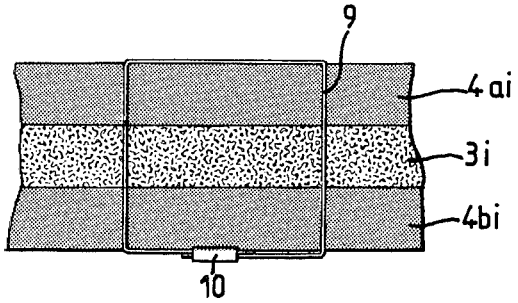
FIG. 5 is a fragmentary horizontal section showing another detail.

By reason of sound insulation requirements, the layers 4*a*, 3 and 4*b* must be perfectly in contact with one another, without any intermediate gap. To this end, the plate assembly $4a_i$, $3_i$ and $4b_i$ of each row is held under a certain compression stress by means of a binding strap 9 consisting of a galvanized metal tape which extends through the three layers to form a loop as shown in FIG. 5. The binding strap 9 is tensioned and locked at 10 by using a suitable tool such as the one currently used for strapping packages or the like. At least one strap 9 is used in the middle of each row.

In the foregoing, it is assumed that the plates $3_1$ to $3_5$ forming the central layer or core 3 are disposed horizontally; however, it will readily occur to those conversant with the art that these plates may also be disposed vertically so that the joints formed therebetween extend at right angles to those formed between the plates $4a_1$ to $4a_5$ or $4b_1$ to $4b_5$.

When the layers 3, 4*a* and 4*b* have been completed in the manner set forth above, the two opposite faces of the partition are lined by applying the external layers 5*a* and 5*b* thereto. Each external lining layer 5*a* and 5*b* consists for example of a plurality of rectangular plates of plasterboard disposed vertically and bonded to the entire outer surface of said intermediate layers 4*a* and 4*b*, respectively, and also to the end wings or flanges of the I-shaped uprights 2 so as to cover said wings. Moreover, the plates of the plasterboard constituting the external lining layers 5*a* and 5*b* are also bonded to each other along their vertical edges. The plates of plasterboard may be for instance 2.5-meter long and 1.2-meter wide.

After finishing with a suitable coating or filling paste and sand-papering the joints between the plates of plasterboard, the partition is ready to receive any desired and suitable decoration material such as paint, wallpaper or fabric.

Due to the presence of three separate layers 3, 4*a* and 4*b* of materials having different densities between the plates of plasterboard constituting the outermost layers 5*a* and 5*b* of the partition, the degree of sound and thermal insulation obtained is definitely higher than that recorded with hitherto known sandwich-structured partitions comprising as a rule only one insulating material. Moreover, any risk of fire is safely avoided since no inflammable or combustible materials likely to release toxic gases when exposed to high temperatures are used in the partition of the invention.

By way of example, in the sandwich partition described above, the I-shaped uprights 2 may have a width of about 60 mm, the glass-wool or rock-wool plates of the central layer or core 3 may be about 20-mm thick, the plates of agglomerated wooden fiber forming the intermediate layers 4*a* and 4*b* may be about 20-mm thick, and the plates of plasterboard of the lining layers 5*a* and 5*b* may be about 10 mm thick, whereby the total thickness of the basic partition will be about 80 mm. However, it is clear that a wide range of partition thicknesses may be contemplated without bringing any change to the technical steps disclosed hereinabove, by simply using the component elements having a greater or smaller thickness.

Since the materials used for manufacturing the partition 1 described above are easily available commercially, and ready for use, that is, without requiring any preliminary treatment or operation, except the gluing step or the use of bonding cement, the partition can be constructed by using unskilled personnel.

Figure 6:
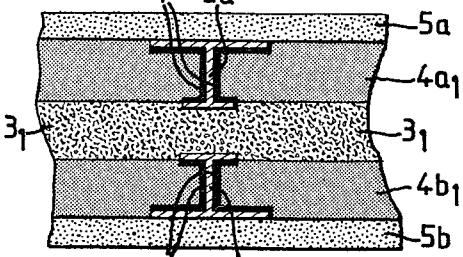
FIG. 6 is a view similar to FIG. 2 illustrating a modified embodiment.

In the foregoing, it is assumed that the uprights 2 consist of metal I-shaped sections. However, in order to avoid any undesired sound-transmitting bridges between the two faces of the partition 1 and to further improve the degree of sound insulation of the partition, each upright 2 may advantageously consist of a pair of T-shaped section elements 2*a* and 2*b*, as shown in FIG. 6. The width of the central web of each T-shaped section 2*a* and 2*b* is substantially equal to the thickness of one of the intermediate layers 4*a* and 4*b* of the sandwich structure. Moreover, each T-shaped section 2*a*, 2*b* comprises a relatively wide outer wing and a relatively narrow inner wing, said wings forming, with the web and on either side thereof, a recess adapted to accomodate the vertical edges of the agglomerated wood chip plates constituting one of the intermediate layers 4*a* and 4*b*. Though in FIG. 6 the two sections 2*a* and 2*b* are disposed in mutually facing relationship, if desired they can be shifted laterally from each other in order further to improve the sound insulation.

Figure 7:
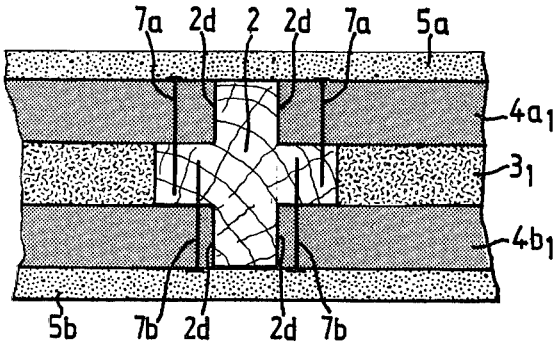
FIG. 7 is a view similar to FIG. 2 but showing another modified embodiment.

FIG. 7 illustrates another modified embodiment in which the metal I-shaped sections 2 of FIGS. 1 and 2 are replaced by fire-proof wooden posts 2 having a cross-shaped cross-section, which are anchored or secured to the floor and ceiling by using any suitable and known technique. As shown in FIG. 7, due to its cross-shaped cross-section, each post 2 provides four rabbets 2*d* in which the vertical edges of plates $4a_i$ and $4b_i$ forming the layers 4*a* and 4*b* are accomodated and secured therein by means of screws or nails 7*a* and 7*b*, respectively. As in the case of the partition shown in FIGS. 1 to 3, the layers 4*a*, 3 and 4*b* are laid row after row.

Figure 8:
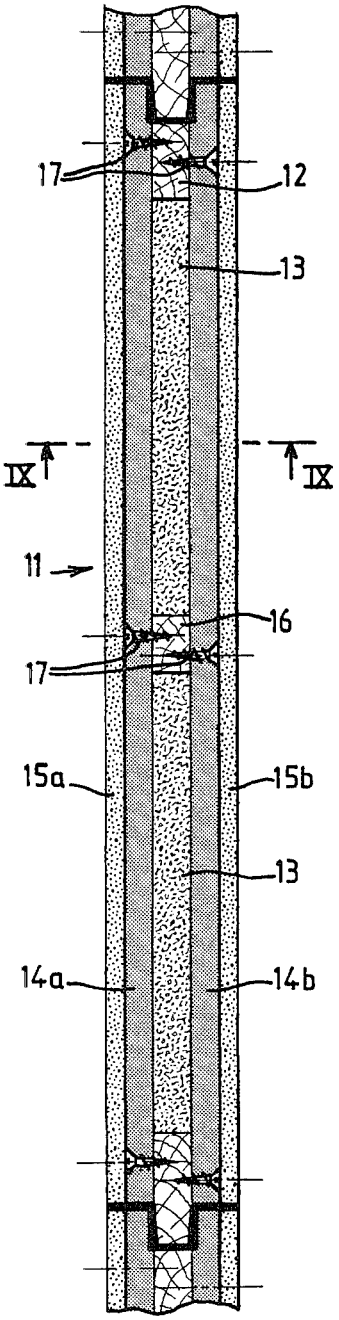
FIG. 8 is a horizontal section showing a laminated partition according to a second embodiment of the invention, the partition being made of prefabricated laminated panels.
Figure 9:
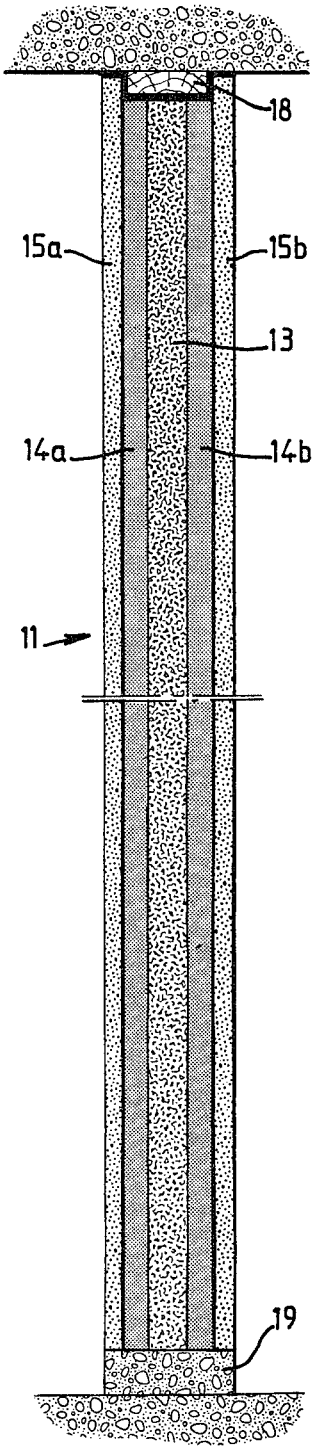
FIG. 9 is a vertical section taken along the line IX—IX of FIG. 8.

In FIGS. 8 and 9, another embodiment of the partition of the present invention is illustrated. The partition II shown in FIGS. 8 and 9 consists of prefabricated panels having each a general structure similar to that of the portion of the partition 1 illustrated in FIG. 1, which extends between two successive uprights 2. More specifically, each prefabricated panel comprises a pair of uprights 12 to which a sandwich consisting of a central layer 13 and two intermediate layers 14*a* and 14*b* disposed on either side of said central layer 13 is fastened, the assembly being completed by two outer lining layers 15*a* and 15*b* bonded to the outer surfaces of the intermediate layers 14*a* and 14*b*.

The uprights or posts 12 consist for instance of wood battens of rectangular cross section (FIG. 8) or of galvanized iron U-shaped sections having a thickness substantially equal to that of the central layer 13 and a length corresponding to the height measured between floor and ceiling, for example 2.50 m.

According to the width contemplated for the prefabricated panel, the central layer 13 may consist of one or a plurality of rectangular glasswool or rockwool plates. Each intermediate layer 14*a*, 14*b* may consist of a single rectangular plate made of wooden chips agglomerated with cement, said plate being disposed vertically and having its vertical marginal portions secured, for example by means of pins, nails or screws 17, to the battens 12 in such a manner that one of the two vertical edges of each rectangular plate 14*a* and 14*b* is diposed about 15 mm behind the outer vertical edge of one of the two battens 12, whereby said one batten will project about 15 mm to form a male tenon, and that the other of the two vertical edges of each retangular plate 14*a* and 14*b* projects about 15 mm from the outer vertical edge of the other of the two battens 12, whereby the latter is recessed about 15 mm to form a female mortise. Each one of the external layers 15*a*, 15*b* may consist of a single rectangular plate of plasterboard which has substantially the same dimensions as the plate 14*a* or 14*b* and which is disposed vertically and bonded without any lateral shift to the outer surface of the plate 14*a* or 14*b*. Thus, a female joint is formed in one of the two vertical edges of the prefabricated panel and a male joint is formed in the other vertical edge. Said male and female joints allow a mortise and tenon joint to be made between the prefabricated panels. The panels are secured to each other by fitting the previously glued male portion of one panel into the female portion of the adjacent panel. The mechanical strength of the male and female portions thus fitted into each other may be improved by mechanical nailing or stapling.

According to the width of the prefabricated panels, one or more intermediate wood battens or metal U-shaped sections of same length as the battens 12 may be provided in the central layer 13 in order to increase the panel stiffness, for example one batten 16 disposed centrally of the width of the central layer 13, as illustrated in FIG. 8. The plates 14*a* and 14*b* may also be secured to the batten 16 for example by using nails, pins or screws 17.

As illustrated in FIG. 9, the horizontal upper edges of the glasswool or rockwool plate 13 and of the two agglomerater woodenchip plates 14*a* and 14*b* are somewhat recessed with respect to the upper horizontal edges of the plasterboard plates 15*a* and 15*b*, so as to form another groove or female joint having a width of about 50 mm and a depth of about 12 mm in the upper horizontal edge of the prefabricated panel.

In a typical example given by way of illustration, not of limitation, the glasswool or rockwool plates constituting the central layer 13 may be 20 mm thick, the agglomerated wood chip plates constituting the intermediate layers 14*a* and 14*b* may each be 15 mm thick, and the plasterboard plates which form the outer leyers 15*a* and 15*b* may each have a thickness of about 10 mm, the prefabricated panel in this case a thickness of about 70 mm. The rectangular plates constituting the intermediate layers 14*a* and 14*b* and the external layers 15*a* and 15*b* may be about 500 mm wide. Their height will depend on the height available between floor and ceiling in the room in which the partition is to be fitted. Given a height of 2.50 m between floor and ceiling, the prefabricated panels may have a height of 2.50 m minus about 2 cm.

The partition 11 illustrated in FIGS. 8 and 9 is fitted as follows. Firstly, a cleat 18 (FIG. 9) about 50 mm wide and 12 mm thick is fixed to the ceiling, by gluing and/or mechanical nailing or screwing. The head of the prefabricated panels, which is previously glued or provided with quick-setting cement, is then fitted to the cleat 18, as shown. As already mentioned above, the prefabricated panels are secured to one another along their vertical edges by interfitting their male and female portions previously glued or coated with quick-setting cement, the fixing being possibly completed by mechanical nailing or stapling. The 2-cm gap thus left at the bottom of the prefabricated panels is then filled with quick-setting cement or motar 19 (FIG. 9) in order to bed the partition bottom to the floor and prevent any water from rising up the partition by capillarity.

From the foregoing it appears clearly that the partition 11 can be erected even by any unskilled personnel.

Of course, the various embodiments illustrated, described and suggested herein should not be construed as limiting the present invention since they are given by way of example, not of limitation. Besides, many modifications and changes will readily occur to those conversant with the art without departing from the basic principles of the invention as set forth in the appended claims. Thus, notably, the lining layers 5*a* and 5*b* or 15*a* and 15*b* may consist, in lieu of the plates of plaster board as suggested herein, of plaster of Paris applied through any known and suitable technical method (e.g. by projection, casting, molding, etc.), whether in situ or at the works, to the intermediate layers 4*a* and 4*b*, or 14*a* and 14*b*.

I claim:

1. A laminated partition for building applications comprising uprights disposed at predeterminated intervals and, in each space between two adjacent uprights, a sandwich structure consisting of several layers of materials, said sandwich structure comprising a central layer or core consisting of at least one rectangular plate made of a first material having a low density and high sound and thermal insulation properties, and, on either side of said core, an intermediate layer consisting of at least one rigid rectangular plate having its vertical edges secured to said uprights and made of a second material having a density which is low, but higher than that of said first material, said second material having good sound and thermal insulation properties, and an external lining layer bonded to the outer surface of the adjacent intermediate layer and consisting of a non-inflammable material having good thermal insulation properties and a higher density than that of said intermediate layer, the density of said first material ranging from about 60 kg/m$^3$ to about 120 kg/m$^3$, the density of the second material of each intermediate layer ranging from about 300 kg/m$^3$ to about 700 kg/m$^3$, and the density of the non-inflammable material of each external linning layer ranging from about 800 kg/m$^3$ to about 1,200 kg/m$^3$.

2. A laminated partition according to claim 1, wherein said core comprises at least one mineral wool plate, each intermediate layer comprises at least one plate of wooden chips agglomerated with cement, and each external lining layer comprises at least one plate of plaster board.

3. A laminated partition according to claim 1, wherein said core is not glued to said intermediate layers.

4. A laminated partition according to claim 1, which is assembled in situ and wherein each upright is anchored vertically between floor and ceiling and has a thickness substantially equal to the sum of the thicknesses of said core and intermediate layers, the external lining layers covering the outer surfaces of said uprights.

5. A laminated partition according to claim 4, wherein each upright comprises a I-shaped metal section.

6. A laminated partition according to claim 4, wherein each upright comprises a wooden post having a cross-shaped cross section.

7. A laminated partition according to claim 1, which is assembled in situ and wherein each upright is fastened vertically between floor and ceiling, and comprises a pair of metal T-shaped sections, each T-shaped section having a central web the width of which corresponds substantially to the thickness of one of said intermediate layers, and a relatively wide outer wing and a relatively narrow inner wing forming with said central web, on either side thereof, a recess accomodating the vertical edge of one of said intermediate layers, said external lining layers covering the outer wings of said metal T-shaped sections.

8. A laminated partition according to claim 1, wherein each intermediate layer comprises a plurality of rectangular plates having a length substantially equal to the distance between said uprights and a width substantially equal to a sub-multiple of the height of the partition, said rectangular plates being disposed horizontally one above the other edge to edge and bonded to each other at their horizontal edges and to said uprights at their vertical edges.

9. A laminated partition according to claim 8, wherein H-shaped brace members are provided between said horizontally disposed plates for holding them in proper vertical and coplanar alignment.

10. A laminated partition according to claim 9, wherein each assembly of two horizontally disposed plates pertaining to the two intermediate layers, respectively, and of a plate of said core therebetween is compressed by means of at least one strap of a galvanized metal tape extending through the three plates to form a binding loop.

11. A laminated partition according to claim 1, wherein two of said uprights and the layers constituting said sandwich structure are so assembled as to form a prefabricated rectangular panel of which the vertical edges are shaped to constitute male and female portions, respectively, allowing a tenon and mortise joint between said prefabricated panel and other similar prefabricated panels.

12. A laminated partition according to claim 11, wherein each one of said two uprights of said prefabricated panel comprises a fire-proof rectangular cross section wooden battens having a thickness substantially equal to that of the core, each intermediate layer of the sandwich structure comprises a single rectangular plate disposed vertically and having its vertical marginal portions so fastened to said uprights that the vertical edges of each of said rectangular plates are the one inwardly off-set and the other outwardly off-set in relation to the outer vertical edges of said uprights, respectively, and each external lining layer of said sandwich structure comprises a single rectangular plate having substantially the same dimensions as the plate forming the adjacent intermediate layer, said external layer forming plate being disposed vertically and bonded to the outer surface of the adjacent intermediate layer forming plate without any lateral shift, so that, at one vertical edge of the prefabricated panel, the outer vertical edge of one batten be recessed in relation to the vertical edges of the four plates forming the intermediate and external layers of the sandwich structure, in order to form said female joint portion, and that, at the other vertical edge of said prefabricated panel, the outer vertical edge of the other batten projects from the vertical edges of the four plates forming said intermediate and external layers of the sandwich structure in order to form said male joint portion.

13. A laminated partition according to claim 12, wherein upper horizontal edges of said core and of the two plates forming said intermediate layers of the sandwich structure are recessed in relation to the upper horizontal edges of the two plates forming the external layers of said sandwich structure, in order to form another female joint portion at the upper horizontal edge of said prefabricated panel.

* * * * *